US010156428B2

(12) United States Patent
Fultz et al.

(10) Patent No.: US 10,156,428 B2
(45) Date of Patent: Dec. 18, 2018

(54) SECURITY DOOR

(71) Applicants: Dan L. Fultz, Louisville, KY (US); Harold L. Snook, III, Crestwood, KY (US)

(72) Inventors: Dan L. Fultz, Louisville, KY (US); Harold L. Snook, III, Crestwood, KY (US)

( * ) Notice: Subject to any disclaimer, the term of this patent is extended or adjusted under 35 U.S.C. 154(b) by 0 days.

(21) Appl. No.: 15/330,519

(22) Filed: Sep. 30, 2016

(65) Prior Publication Data

US 2017/0299347 A1 Oct. 19, 2017

Related U.S. Application Data

(63) Continuation-in-part of application No. 14/545,297, filed on Jan. 16, 2015, now Pat. No. 9,766,045.

(60) Provisional application No. 62/284,448, filed on Sep. 30, 2015.

(51) Int. Cl.

| | |
|---|---|
| ***F41H 5/22*** | (2006.01) |
| ***E06B 5/10*** | (2006.01) |
| ***E06B 3/26*** | (2006.01) |
| ***E06B 3/54*** | (2006.01) |
| ***E06B 1/70*** | (2006.01) |
| ***E06B 3/10*** | (2006.01) |
| ***E06B 3/68*** | (2006.01) |
| ***F41H 5/04*** | (2006.01) |
| ***F41H 5/24*** | (2006.01) |
| ***F41H 5/26*** | (2006.01) |
| *E06B 3/70* | (2006.01) |

(52) U.S. Cl.

CPC ..... *F41H 5/226* (2013.01); *E06B 1/70* (2013.01); *E06B 3/105* (2013.01); *E06B 3/26* (2013.01); *E06B 3/5454* (2013.01); *E06B 3/68* (2013.01); *E06B 5/106* (2013.01); *F41H 5/0407* (2013.01); *F41H 5/24* (2013.01); *F41H 5/263* (2013.01); *E06B 2003/703* (2013.01); *E06B 2003/7051* (2013.01); *E06B 2003/7063* (2013.01); *E06B 2003/7067* (2013.01)

(58) Field of Classification Search

CPC . F41H 5/22; F41H 5/223; F41H 5/226; F41H 5/24; F41H 7/00

USPC ..... 89/36.04; 109/64, 73, 75, 76

See application file for complete search history.

(56) References Cited

U.S. PATENT DOCUMENTS

| | | | | |
|---|---|---|---|---|
| 2,368,935 | A * | 2/1945 | Lodwig | E06B 5/12 126/200 |
| 4,878,314 | A | 11/1989 | Blockinger | |
| 5,319,879 | A | 6/1994 | Rozycki | |
| 5,365,696 | A | 11/1994 | Ruiz | |
| 5,862,645 | A | 1/1999 | Lee | |
| 6,279,280 | B1 | 8/2001 | Plager | |
| 7,100,343 | B2 | 9/2006 | France | |
| 8,154,788 | B2 | 4/2012 | Millett | |
| 8,397,450 | B1 | 3/2013 | Neal | |
| 8,844,219 | B2 | 9/2014 | Neal | |
| 2002/0046500 | A1 | 4/2002 | Hingston | |

(Continued)

*Primary Examiner* — Stephen Johnson

(74) *Attorney, Agent, or Firm* — Carrithers Law Office, PLLC

(57) ABSTRACT

A stile and rail ballistic security door containing bullet proof materials within a metal or synthetic material frame including a plurality of window panes and thermal break means to eliminate condensation problems therein. The door contains a multi-layer exterior core providing extra strength and rigidity.

16 Claims, 20 Drawing Sheets

(56) References Cited

U.S. PATENT DOCUMENTS

| | | | | |
|---|---|---|---|---|
| 2003/0200714 | A1 | 10/2003 | Minke | |
| 2004/0226231 | A1 | 11/2004 | Dlubak | |
| 2008/0263958 | A1 | 10/2008 | Edson | |
| 2010/0282137 | A1 * | 11/2010 | Neal | E06B 3/68 109/77 |
| 2011/0262721 | A1 | 10/2011 | Albertelli | |
| 2011/0314738 | A1 | 12/2011 | Harriott | |
| 2014/0352240 | A1 | 12/2014 | Matta | |
| 2014/0360416 | A1 | 12/2014 | Deiler | |

* cited by examiner

SECURITY DOOR

REFERENCES TO RELATED APPLICATIONS

This application is a Continuation-In-Part of U.S. application Ser. No. 14/545,297 filed on Jan. 16, 2015, now U.S. Pat. No. 9,766,045, and claims priority from U.S. Provisional Patent Application 62/284,448 filed on Sep. 30, 2015 both of which are incorporated by reference herein in their entirety.

FIELD OF INVENTION

This invention relates to an aesthetic light/vision transmitting ballistic resistant security door fabricated from wood, metal, synthetic polymers and bullet resistant panels or other translucent or transparent polymers.

BACKGROUND OF INVENTION

In an increasingly violent society, homes, businesses, government and civic establishments are often targets of such threats as armed attacks, burglary, kidnapping and vandalism. Such threats not only involve damage and destruction of personal or commercial property, but also potential bodily harm to families, employees and the public. Due to such threats, business and home owners have installed security doors to resist or prevent entry. Conventional bullet resistant security doors typically are solid structures or solid with a single small multi-layer glass pane offering limited visual or aesthetic properties. Exterior security doors fabricated from wood, wood laminate or metal seldom have multiple glass vision panels due to problems maintaining structural integrity and with condensation and/or fogging due to temperature variations. Conventional construction of a door with a plurality of glass panes (TDL, true divided light), lack the structural integrity to withstand damage resulting from high velocity projectiles directed toward the glass or the surrounding rail and stile door panels. Likewise typical security doors with the view panels require a direct and permanent connection between the interior and exterior steel reinforced glazing stops which leads to issues of condensation and fogging. When view, light and security are desired or required, bullet resistant security doors must consist of an assembly of components that address all of these typical deficiencies.

Conventional security doors used in office buildings, banks and other commercial or civic installations are typically comprised of a metal skin typically of roll formed steel laid over a dense wood or synthetic rigid core. Moreover, if the doors or windows contain a bullet resistant glass, the glass is typically of limited size and riveted between steel straps, crossed bars or perforated panels. There are typically no provisions to maintain minimum insulating properties while still providing security, visual, and sound reduction properties. Due to a lack of a physical break between outdoor and indoor thermal conducting materials, these doors and windows tend to sweat (condensate) when used to separate areas with large temperature differentials as with an exterior door.

Security doors have been used for a number of years. Typically, these doors have solid steel panels or jail door-like appearance wherein heavy steel bars stretching vertically and horizontally in front or within the door core to protect the doorway from forcible entry. While attempts have been made to improve the appearance of these doors, none have offered design flexibility flexible size, shape and finish; large vision panels, low thermal conductivity; and aesthetic compatibility all within a bullet resistant security door product.

The present invention addresses the aesthetic, thermal conductivity and security properties of exterior/interior doors. The component selections, fabrication, and assembly procedure of the present invention accomplishes this through variable levels of security performance, multiple transparent visual panels, scalable door width/height dimensions, variations in the shape, size, and configuration of the glass divides, aesthetic appearance with various exterior/interior finish options to compliment installation design directives, and a thermal separation between exterior and interior environments.

SUMMARY

This present invention relates to an aesthetic ballistic security door fabricated from wood, metal, synthetic polymers and bullet proof glass or other translucent or transparent polymers.

The security door products are constructed to provide aesthetically pleasing security doors for banks, government buildings, commercial offices, churches, restaurants, and even homes so that visitors are not even aware of the special security installations.

The security door assembly comprises or consists of an operable single or pair multi-layered component assembly of select species wood, steel and light/vision transmitting panes. The door assembly is set/secured in place with hinges/hardware in a select species wood and/or steel head, jamb and threshold frame secured to adjacent building frame. The door assembly is suitable for both exterior and interior installations, new or existing construction.

The security/bullet resistant door assembly consists of exterior and interior multi-layer wood cores bonded to an inner-structural plate and grid assembly of steel/armor plate, stainless steel, copper, bronze, aluminum, titanium, graphite polymer, graphene polymer, high density polyethylene polymers, polycarbonate, carbon fiber, and/or combinations of other similar compatible impact resistant materials. Multiple (TDL, True Divided Lights) panes/panels of bullet resistant materials such as laminated transparent, one-way, reflective, and/or translucent glass or polycarbonate are used in the construction of the opaque and/or light transmitting panels. The security door also contains a thermal break insulating membrane, physically separating the exterior and interior (high coefficient thermal conductive) steel inner-structural plate and grid components. The door assembly is intended to provide single or multiple divided vision/light panes while maintaining the prescribed security level attack resistant properties in accordance with the present invention.

The security door is fabricated from wood, wood laminates, fiberglass, steel, aluminum, graphite, graphene, ceramic, or other metal, mineral, and/or synthetic polymers together with bullet resistant translucent or transparent glass or polycarbonate inserts. The present invention relates to a method of fabrication and construction of aesthetic, multi-pane glass security doors containing bullet resistant glass within a layered wood and steel rail and stile door frame assembly including half-lap meeting rails, integrated multi-point locking hardware, and low rise accessible slip resistant threshold. Moreover the doors are fabricated with a thermal break to resist condensation or frosting issues on the inside of the glass or door. The steel panels are imbedded within a wood core which provides the initial projectile energy absorption layer and may be covered with wood veneers, decorative metal veneers, polymers and/or other suitable finish materials or combinations thereof as maybe desired or specified.

The method of fabrication provides a means for constructing visually pleasing and variable design security doors for banks, government buildings, schools, commercial offices, churches, restaurants and residences with the intent that visitors are not made aware of the special security installations. The fabrication/assembly method allows highly flexible design characteristics as to size, shape, and number of vision panes; size, shape, paired or single, operable or fixed, rectangular or arched top door panels; various exterior and interior wood veneer, painted or metallic finishes for desired or 'as specified' design capability. Additionally, the design allows for 'in place' future access to the glass panes for repair or individual pane replacement.

Door assembly uses tamper resistant, balance adjustable, offset pivot hinges, top and bottom, offset intermediate butt hinges, full height multi-point interlocking steel locking hardware with concealed head and sill shoot bolts, half-lap center meeting stile and full perimeter weather stripping (exterior installations, or sound transmission abatement on interior installations). The half-lap design utilized on paired doors minimizes the physical separation of the imbedded armor plate, eliminates any clear view of projectile path between doors, and provides for both interior and exterior weather/sound stripping.

More particularly, t security door comprises or consists of a frame comprising structural members selected from the group consisting of steel, metal, stainless steel, copper, bronze, aluminum, titanium, wood, graphite polymer, graphene polymer, high density polyethylene polymers, nylon, and combinations thereof. The door contains bullet or projectile resistant transparent or translucent panes comprising glass or synthetic material. Thermal break means comprising vented channels include spaced apart support members having a synthetic vapor transmission material disposed therein. The security door may include one or more dividers partitioning and forming window panes within a window or door fabricated in accordance with the instant invention.

The doors are fabricated with a thermal break to eliminate condensation on the inside of the glass or door. The steel door panels may be covered with a film and/or polymer, fiberglass, wood or other laminate and may include solid wood members covering portions of the steel frame.

The frame includes at least a multi-layer exterior core, an interior core, an interior bullet proof grid plate, a window pane divider grid, and an exterior flat grid plate which holds the window panes within the window pane divider which serve to dissipate force, absorb energy and act as a thermal break. One multi-layer exterior core includes at least four flat frame members bonded to one another. The four frame members each comprise two vertical and two horizontal bands connected at four corners thus forming rectangular bands.

An embodiment of the security door comprises or consists of an operable, single or pair, bullet resistant security door comprised of a multiple layer assembly of select species wood, steel, and light/vision transmitting panes set in a surrounding select species wood and/or steel head, jamb, and threshold frame secured to adjacent building. The assembly comprises a multi-layer exterior wood core. An interior and exterior structural plate assembly consists of steel/armor plate, metal, stainless steel, copper, bronze, aluminum, titanium, graphite polymer graphene polymer, high density polyethylene polymers, polycarbonate, carbon fiber, and/or combinations thereof. A structural divider light/vision pane divided grid consists of the same or compatible material as the two-piece structural plate. Projectile or bullet resistant transparent or translucent light/visual transmitting panes comprising of multi-layer glass, polycarbonate, synthetic translucent material, and/or combination thereof are disposed in a multi-layer interior wood core.

Furthermore, the security door assembly comprises two horizontal (rails) and two vertical (stiles) chemically and mechanically bonded wood and steel layers; the four (rail & stile) members are connected at four corners thus forming a rectangular or arched top rail (as may be specified) door panel. The door panel center void has multiple divided, square, rectangular or curved gridded frame 'boxes' for placement of light/vision panes. The security door can include a membrane of low thermal conductivity material separating the exterior armor plate and the inner-light panes divider grid. The LTC material comprises of 1 or 2 adhesive sided structural glazing tape, polyvinyl chloride (PVC) tapes, neoprene strips, cork strips, or closed cell foam glazing tape; the materials applied in thicknesses as appropriate for desired insulating properties. The security door comprises design flexibility and aesthetic compatibility not currently available; the security door includes translucent and/or vision panes in (as specified) shapes and sizes and interior and exterior veneers and/or finishes (as specified) for compatible design aesthetic. The security door provides bullet/intruder resistant/intruder security, reduced thermal conductivity, in-place access to glazing and interior structural core for future maintenance or glass replacement, all while maintaining the more inviting, understated, and less intimidating, desired aesthetic of a non-high security door assembly.

It is an object of the present invention to provide a bullet resistant security door including a translucent and/or vision panes in a selected shape and a selected size, an interior veneer, and an exterior veneer and/or finish.

It is an object of the present invention to provide a security door for bullet/intruder resistant/intruder security, reduced thermal conductivity, in-place access to glazing and interior structural core for future maintenance or glass replacement, all while maintaining the more inviting, understated, and less intimidating, desired aesthetic of a non-high security door assembly.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the several views and wherein:

FIG. 22 is an order of assembly axon showing the security door steel components wherein the steel grid or 'egg crate' dividers are welded onto the interior steel core plate and the exterior steel core plate grid separated by the thermal break material from the steel grid dividers and covers the bullet resistant glass assembly component disposed there between.

DESCRIPTION OF THE PREFERRED EMBODIMENT

Figure 1:
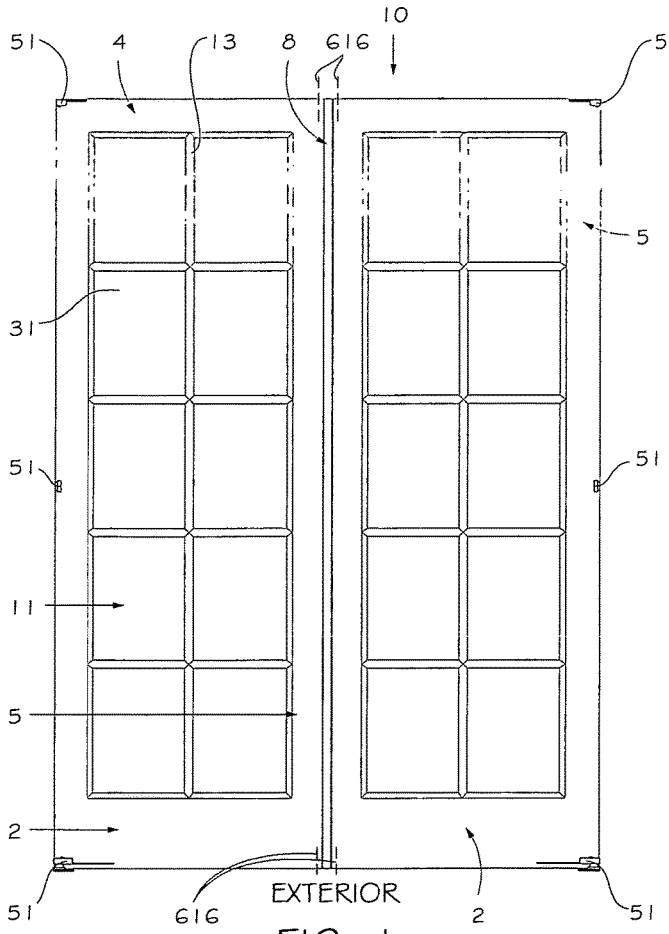
FIG. 1 is a front exterior elevated view of a paired out-swing security door of the present invention.

As used herein, the term "about" can be reasonably appreciated by a person skilled in the art to denote somewhat above or somewhat below the stated numerical value, to within a range of ±10%.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list A list of reference numbers used to describe the elements in the drawings is as follows:

2. Bottom rail assembly
4. Top rail assembly
5. Stile assembly (vertical)
6. Jamb assembly
7. Deleted/not used
8. Half lap meeting stile assembly
9. Deleted/not used
10. Security door assembly
11. Insert panel assembly—metal, polymer, glass (clear, translucent, opaque), or combination
12. Exterior veneer
13. Exterior muntin divide trim
14. Interior muntin divide trim
15. Interior veneer
31. Bullet resistant glass panes/panels
41. Thermal break material
42. Neoprene setting block/shim material
43. Adhesive back structural glazing tape
44. Magnetic strip tape
51. Hinges (top, bottom & intermediate)
61. Stainless steel 5-point semi-concealed lock/latch/handle assembly
69 Barrel nut through bolt
71. Weather stripping
73. Weather seal 'T' reglet track
75. Slip resistant grooves/ridges/sill plate
80. Weather stripping/door sweep
81. Threshold assembly
82. Stainless steel structural stop block
83. White oak stop block cover
91. Door frame
92. Interior frame door stop block
111. Exterior wood core assembly

112. Interior wood core assembly
211. Exterior steel core flat grid plate
2112 Flat head stainless steel threaded fastener
212. Steel core middle 'egg crate'
213. Interior steel core flat grid plate
609. deleted/not used
611. Active leaf reinforced lock/set/handle housing
612. Top and bottom 'horn' hooks
613. Top and bottom 'horn' hook keepers
614. Inactive leaf reinforced keeper/handle set housing
615. Multipoint lockset strike stile escutcheon plate
616. Top and bottom shoot bolts
811. Stainless steel sill lug/pivot hinge mounting plate
812. Slip resistant bronze plate
813. Extended threshold sill horn
1111. T-shaped edge band block (top/inner)
1112. (inner layer of core 111)
1113. (inner layer of core 111)
1114. (inner layer of core 111)
1115. (inner layer of core 111)
1116. (inner plug layer of core 111)
1117. T-shaped edge band block (bottom/outer)

As shown in FIGS. 1-22), the security door assembly 10 comprises or consists of a rail and stile door assembly consisting of structural core members selected from the group consisting of steel/armor plate, stainless steel, copper, bronze, aluminum, titanium, wood, graphite polymer, graphene polymer, high density polyethylene polymers, nylon, and/or combinations thereof. The door 10 also contains bullet and projectile resistant transparent, translucent, or one-way reflective panes comprising layered glass or synthetic material. A thermal break is accomplished by providing a rigid or semi-rigid synthetic insulating thermal transfer material as a physical separation between exterior and interior steel core components. The security door may include one or more TDL dividers partitioning vision/light panes within a door fabricated in accordance with the present invention.

The rail and stile, single or paired security doors are built as a bonded, layered frame and panel construction. The stiles (5) comprise vertical boards that run the full height of a door and compose its right and left edges. The top and bottom offset pivot hinges and intermediate butt hinges (51) are mounted to the top, bottom and midpoint edges. The multipoint latch/lock assembly (61) including the handle, lock, top and bottom shoot bolts (616), and integral 'horn' hooks/keepers (612) are mounted on the swinging side (known as the "latch stile"). The rails (2, 4), comprise horizontal boards at the top, bottom, and optionally in the middle of a door that join the two stiles and spit the door into one or more rows of panels. The top rail (4) and bottom rail (2), (sometimes referred to as the "kick rail"), joins the stiles (5). A middle rail may optionally be disposed at about the height of the handle set providing a "lock rail", and/or other horizontal rails commonly known as "cross rails", may be used as well. It is also contemplated that mullions and/or muntin divides defining smaller optional vertical and horizontal TDL (true divided lights) that run between both rails and stiles and divide the door into single or multiple vertical and horizontal framed 'lights' may be used to provide light/vision openings in the doors. The figures illustrate a plurality of TDL muntin divides which are optional vertical and horizontal members that divide the door into smaller panels. Panel (11) is composed of a selected material such as metal, polymer, bullet resistant transparent, translucent, one-way reflective glass, polycarbonate, synthetic material or combinations thereof, fill the space between the stile, rails, and muntin divides. The preferred embodiment utilizes decorative opaque panels or an arrangement comprise layers of clear or translucent bullet resistant glass (31) and/or clear or translucent polymers defining lights which fit into the rigid steel frame surrounds thus, becoming an integral component of the bullet resistant property of the door. Panels (31) may be flat, or in raised decorative panel designs and can be secured in place with adhesive back glazing tape (43), non-adhesive insulating membrane tapes or stay as a floating panel.

Figure 2:
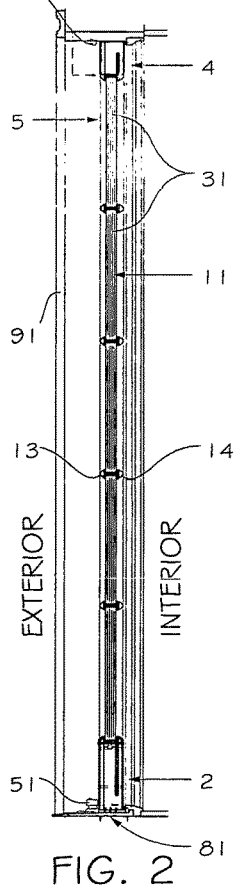
FIG. 2 is a side cross-sectional view of the door of FIG. 1 showing the top rail assembly, the glass panel assembly, muntin bar divides, and bottom rail assembly.
Figure 3:
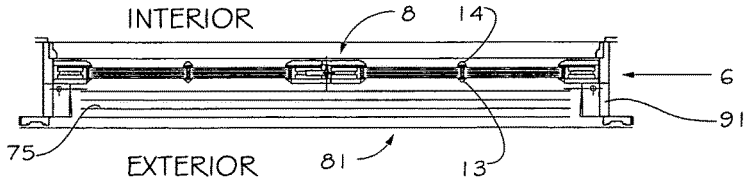
FIG. 3 is an overhead cross-sectional view of the door of FIG. 1 showing the jamb (stile) assembly, glass panel assembly, muntin bar divides, and half-lap meeting stile assembly.

More particularly, as shown in FIGS. 1-3), an exterior front view of security door (10) illustrates the stiles (5), rails (top rail (4) and bottom rail (2), muntin divides (13 and 14), view panel (11), and hinges (51) wherein the wood core components comprise a two piece laminated Sapele Mahogany including an layered exterior wood core and an interior layered wood core. The core can comprise various hardwood species including laminated veneer lumber and/or stave core laminated wood consisting of either hardwood or softwood species. The exterior (12) and interior (15) surfaces are composed of a finished veneer such as a mahogany veneer, but could comprise other wood, metal veneer, synthetic veneers, fiberglass, plastic, paint, or metallic coatings.

FIG. 2 is a side cross-sectional view of the door assembly (10) of FIG. 1 showing the top rails assembly (4) details including the glass panel assembly (11), muntin bar divides (13 and 14) and bottom rail assembly (2).

Figure 4:
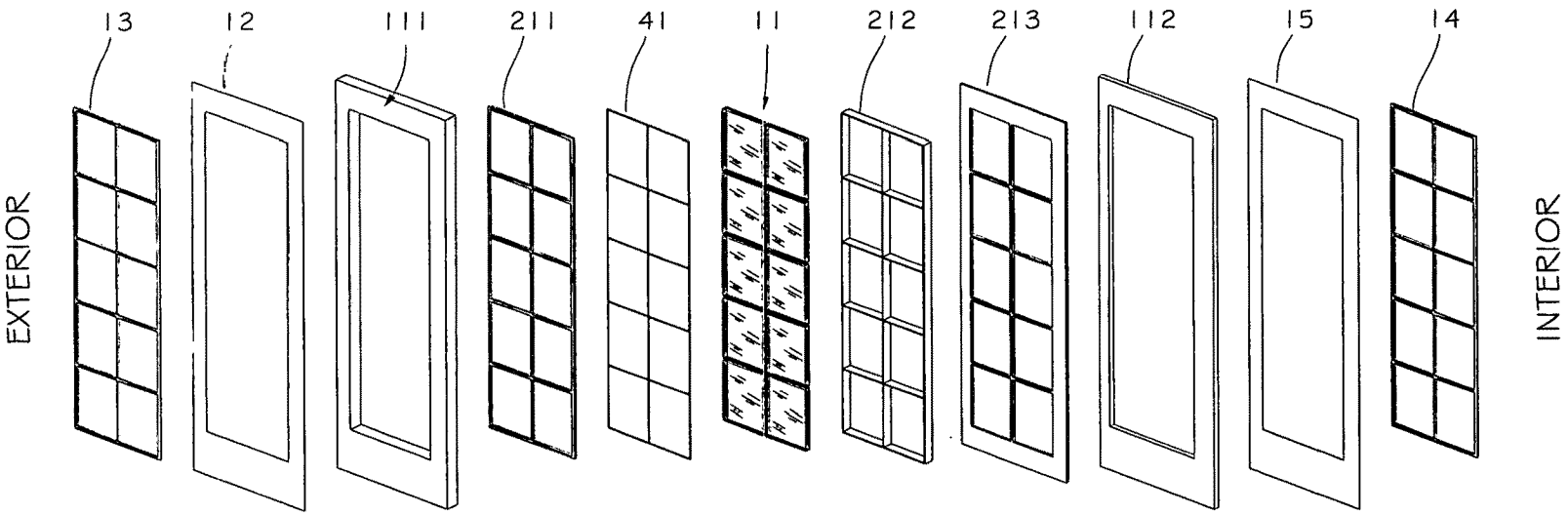
FIG. 4 is a perspective view of the door shown in FIGS. 1-3, illustrating an expanded door assembly showing the layered components of one preferred embodiment of the security door including, from left to right: a finished exterior muntin divide trim cover, an exterior finished veneer, an exterior wood core, a steel core exterior flat grid, a thermal break membrane, a panel assembly including a plurality of glass and/or polymer clear or translucent bullet resistant material panels/panes, a steel core middle 'egg crate' grid, a steel core interior flat plate, an interior wood core, an interior finished veneer, and a finished interior muntin divide trim cover.

FIG. 3 is an overhead cross-sectional view of the door assembly (10) of FIG. 1 showing the jamb (stile) assembly (6), glass panel assembly (11), muntin bar divides (13), and half-lap meeting stile assembly (8);

FIG. 4 is an expanded perspective view of the door shown in FIGS. 1-3, illustrating the component assembly sequence of the security door (10) assembly representing the layered components of one preferred embodiment of the security door including, from left to right, a finished exterior muntin divide (13), an exterior finished veneer (12), an exterior layered wood core assembly (111), a steel core exterior flat grid (211), a thermal break membrane (41), a panel assembly including a plurality of clear or translucent bullet resistant layered glass or polymer material (11), a steel core middle 'egg crate' grid having a thickness to hold the glass therein defining TDL spacers or dividers (212), a steel core interior flat plate (213), an interior layered wood core (112), an interior finished veneer (15), and a finished interior muntin divide trim (14). As shown in the drawings, each of the components in FIG. 4 has an exterior side facing to the left and an interior side facing to the right.

The interior and exterior muntin divides comprise a solid wood Sapele Mahogany TDL (true divided lights) muntin divide grill (13 and 14) applied trim which is attached to an exterior steel plate (211) and interior steel plate (213) with a two-sided adhesive tape (43), such as 3M VHB structural glazing tape. Grid trims may also be attached with adhesive back magnetic tape (43). The threshold assembly (81) includes the multi-piece overlapping plate assembly with slip resistant grooves or ridges (75) and structural stop block (82) covered with a weather-seal (71) set in a reglet track (73).

For exterior applications, thermal break material (41) such as for example, a thermal glazing tape or adhesive back rigid or semi rigid thermal insulating material is to be disposed between the exterior steel core grid (211) and the steel grid divides (212). The thermal break material (41) provides thermal and physical separation of the steel components thus resisting interior condensation forming therein or thereon.

The panels of glass (31) may include film disposed between multiple layers of glass to achieve the desired bullet resistant properties and/or a tint, low emission film, and/or reflective, low ultraviolet and/or infrared radiation coatings, low emissivity silver coatings, low emissivity pyrolytic coatings, frosted, opague, or translucent material. An adhered sheet of polycarbonate material, which may be clear or transparent, or other impact resistant polymer comprises the interior surface of the bullet and projectile resistant panel (31) of assembly (11) in order to prevent explosive glass shards, or particles thereof resulting from high velocity projectile and/or intruder mass/force impact. It is anticipated that products such as Corning's GORILLA® glass may also be incorporated in the present invention. It should be noted that in a preferred embodiment, the middle steel grid comprising spacers/dividers (212) are welded to the surface of the interior flat steel plate 'egg crate' grid (213) so as to provide and maintain the structural integrity of the vision components.

A more detailed description of the component materials of construction for the ballistic door of the security door Is as are as follows:

Rail and Stile Door Frame

The preferred embodiment of the rail (2, 4) and stile (5) comprises an exterior multi-layer core (111) and an interior multi-layer wood core (112) of laminated Sapele Mahogany, chemically bonded under pressure. Other core materials may be utilized including various hardwood species, laminated veneer lumber (LVL), stave core laminated wood comprising of either a hardwood or a softwood species, and/or combinations thereof.

The rail and stile finished surface of the preferred embodiment is Sapele Mahogany veneer (12). Alternate finished surface materials may be 'as specified' including any available wood veneer species suitable (in finished form) for exterior exposure, high density PVC veneer, any ⅛"+/− thick wood or metal veneer material suitable as bonded base for stain/clear coat finish, hard/spray paint finish, or LUMINORE type spray metallic finish.

The muntin divides trims (13, 14) of the preferred embodiment are CNC profiled Sapele Mahogany applied to TDL exterior (211) and interior (213) steel applied grids. Muntin divides attach to steel core plates (211, 213) with 3M VHB (43) 2-sided adhesive tape. Alternate muntin divide trim materials may be utilized including those matching/compatible with selected rail and stile finished material listed above. Exterior muntin trim grid may be attached with adhesive back magnetic strip tape (44) for future maintenance and/or repair access to steel core (211) and TDL glass panels (31).

Metal Core

An effective amount of a metal, for instance, 5/16" armor plate steel can be used in the instant invention; however, other materials including flat plate steel, stainless steel, titanium, aluminum, copper, brass, graphite materials, ceramic materials, and polymers and/or combinations thereof can be used so long as they maintain the prescribed bullet resistant properties. Typically, the least expensive available material is flat plate steel. However, consideration as to total assembled door weight and desired security performance levels will impact the selection of component materials.

As shown in the drawings, the exterior steel core grid member (211), middle divider steel core 'egg crate' member (212), and interior steel core panel member (213) comprised of armor plate steel in various thickness as appropriate for specific ballistic resistance requirements. The middle 'egg crate' grid spacer/divides (212) hold the TDL (true divided lights) glass in position. Alternate materials for these components include stainless steel, bronze, aluminum plate material in thickness as appropriate for specific ballistic resistance, weight and/or corrosive resistant requirements.

Panels

The preferred embodiment glass panel assembly (11) includes a plurality of glass TDL panes (31) that are ballistic resistant 'Level 5' laminated glass with a sheet of impact resistant material such as polycarbonate adhered to or disposed onto the interior face of the glass (31). Alternate materials include ballistic resistant laminated clear or one-way reflective glass, full thickness single or multi-layer polycarbonate clear or translucent panels, film laminate, decorative steel and/of/or laminated opaque flat, raised, or sculpted panels of 'as specified' various security levels. The laminated glass typically includes a clear polymer film between layers to prevent/reduce shattering on the secure side. The present invention glass panes (31) also include a polycarbonate interior surface layer for positive protection against impact generated explosive glass projectiles.

Thermal Break/Glazing Material

A novel feature of the instance invention is the utilization of a thermal break/glazing material (41) such as VHB (3M VHB), a 2-sided structural glazing tape in thicknesses appropriate for the desired thermal separation. Alternately, high density, 2-sided adhesive Polyvinyl Chloride (PVC), neoprene strips, adhesive back cork strips, and/or closed cell foam glazing tapes may be utilized to provide separation, sound abatement, and as a glass to steel isolator. High density neoprene blocks/strips (42) are used between lower edge of glass panels (31) and steel dividers (212) as a positioning support shim and component isolation pad. However, the same high density neoprene block/strip material (42) in thickness as appropriate for shimming the glass may be used on any or all four edges providing additional thermal separation and isolation of glass panels (31) and steel frame components (211, 212, 213).

The thermal break material (41) may be applied in adhesive or non-adhesive back sheets or strips to prevent potential interior surface condensation problems on exterior installations. For interior only applications, a single piece structural glazing tape (43) may replace the thermal break material (42) between steel components (211) and (212) to secure the glass/panel components assembly (11) within the steel core assembly. It is anticipated that a semisolid chalk or silicone material which can be applied from a tube may also be applicable as a suitable thermal break material.

Hinge Assembly

A preferred embodiment as shown in the attached figures includes tamper resistant balance adjustable top offset pivot hinge (51), bottom offset pivot hinge (51), and one or more intermediate offset butt hinges (51) comprised of stainless steel or available suitable materials with or without applied finish wherein, the pivot hinge design load rating exceeds the door leaf design weight. Alternative hinges can be constructed based on the door leaf design weight and aesthetic requirements of the door assembly. Bronze or stainless steel 'wide swing, clear swing' gorilla type butt hinges of 1½ pair, 2 pair, or more as required per leaf weight and installation requirements may be utilized. A full height stainless steel or plated finish piano type hinge may be used following verification of the hinge fasteners holding capacity of the jamb material. Industry standard (i.e. brass, nickel, oil rubbed bronze, painted, etc.) in polished, satin, gloss, matte finishes/colors/textures to compliment specific design/aesthetic requirements are acceptable.

Multi-Point Locking

As illustrated in FIGS. 1, 8, and 19-21), the preferred door contains a stainless steel 5-point semi-concealed lock/latch assembly (61) including top and bottom sliding shoot bolts (616) connected by concealed stainless steel slide bars to the active leaf lock/handled set housing (611). Also connected to housing (611) by same slide bars are intermediate top and bottom 'horn' hooks (612). The inactive door leaf includes a dead bolt/latch keeper/handle set housing (614), 'horn' hook keepers (613) let into stainless steel strike stile escutcheon plate (615), and top and bottom concealed strike stile shoot bolts (616) or flip bolts. Alternative locks include a single part mortise lock 'dead' bolt and latch with top and bottom surface and/or concealed slide/flip bolts. The multi-point locking is initiated by the active leaf handle (611) extending the top and bottom stainless steel shoot bolts (616) into reinforced sleeves set into door frame head (91) and threshold assembly (81) while concurrently rotating the 'horn' hooks (612) into their respective keepers (613), and extending the dead bolt slide.

Weather Stripping

Figure 5:
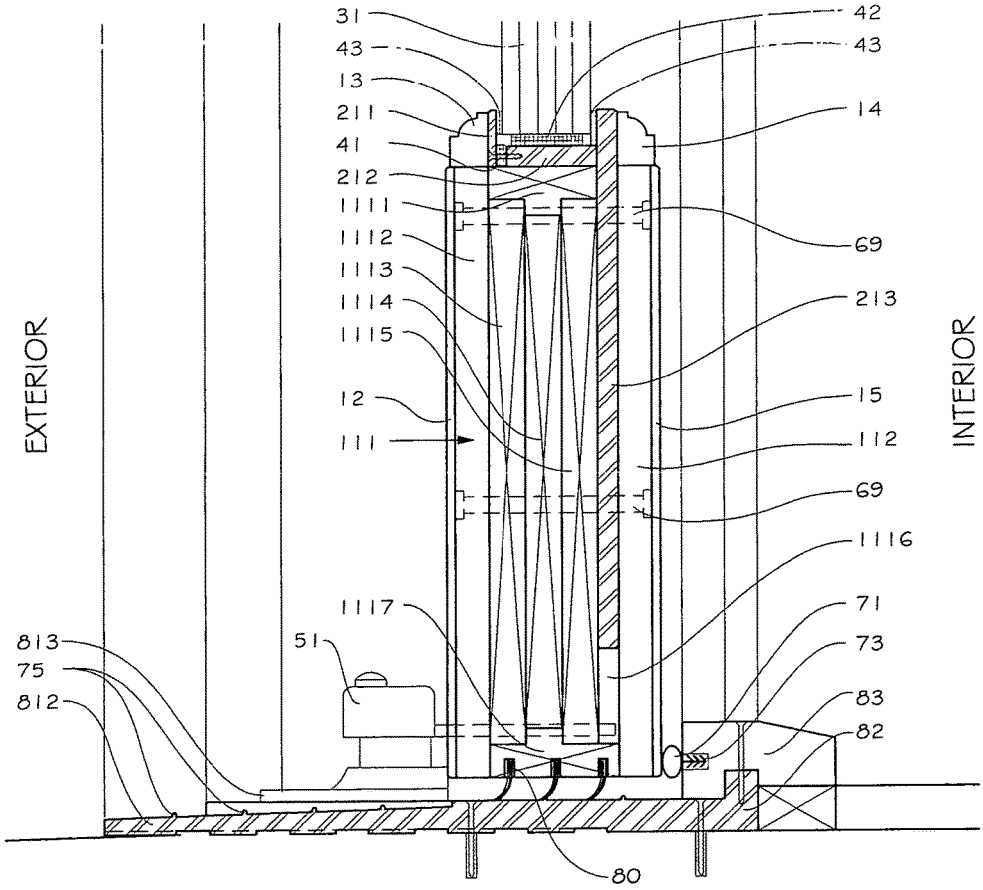
FIG. 5 is a detailed cross-sectional view of the bottom rail assembly and threshold assembly area of the security door as shown in FIG. 2.

Weather stripping (71), as illustrated in FIGS. 5, 7, 8 and 9 consists of kerf back bulb type perimeter weather-seal, adhesive back neoprene bulb type weather-seal and thermoseal neoprene T-back gasket seal set in a 'T' shaped reglet (73). Alternative materials include kerf back open/closed cell foam, neoprene, elastomer, pvc polyblend, PVC, vinyl, or similar weather-seal gaskets, adhesive back or kerf back low density foam, silicone weather-seal, and/or mechanically fastened aluminum track/bulb type weather-seal assemblies. Additional weather stripping is provided by door sweep (80) as shown in FIG. 5.

Threshold

Figure 10:
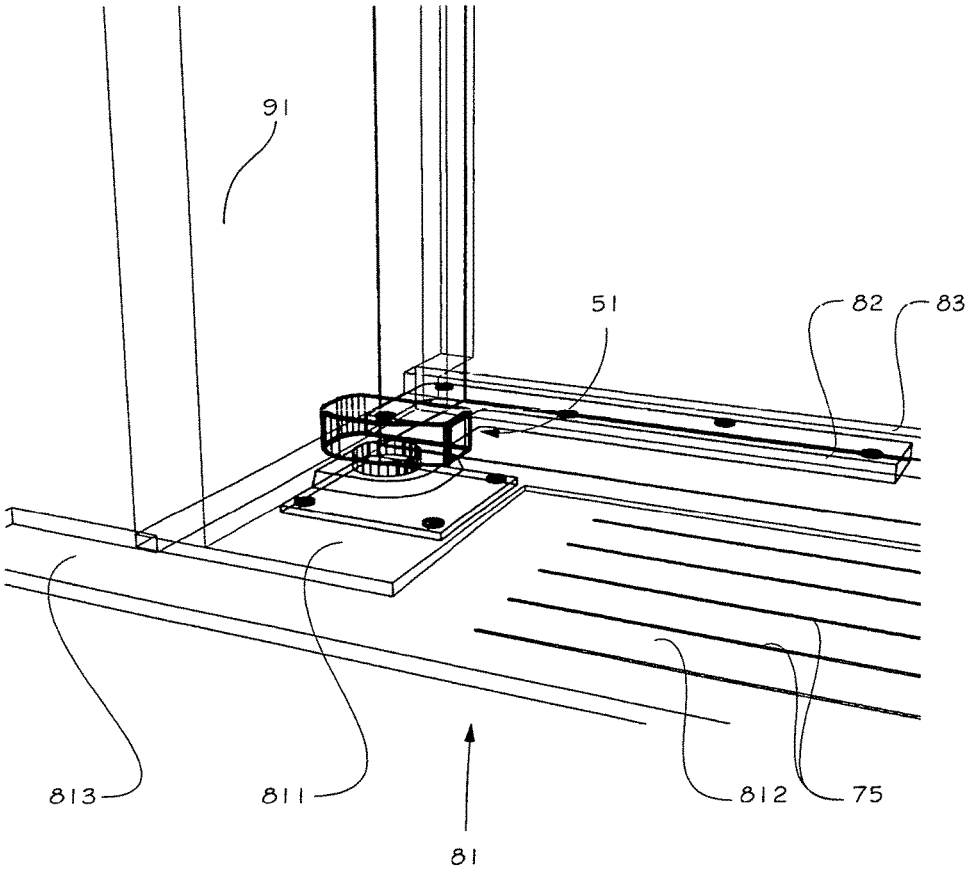
FIG. 10 is a top perspective view of the lower left offset pivot hinge, exterior face of the door and threshold assembly of the security door.
Figure 11:
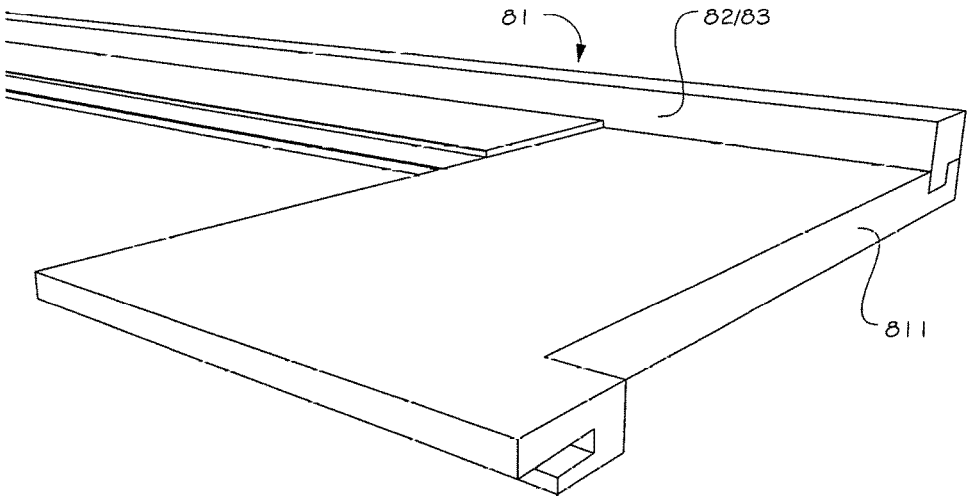
FIG. 11 is a perspective view of the pivot hinge mounting and structural stop block section of the slip resistant grooved threshold assembly.
Figure 12:
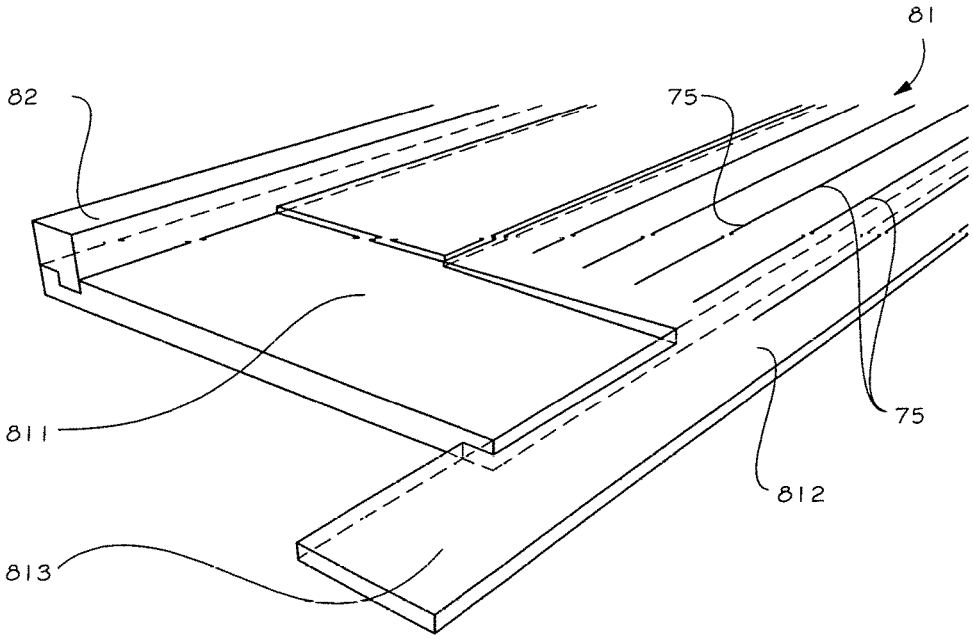
FIG. 12 is an additional perspective view of the grooved slip resistant inset section of the threshold.

The preferred threshold assembly (81), as shown in FIGS. 10-12, is comprised of a flat and a sloped plane two piece assembly which includes a sloped bronze plate (812) with slip resistant grooves or ridges (75) on the walk surface and an overlapping/interlocking flat plane stainless steel lugged pivot hinge mounting plate (811). A stainless steel structural stop block (82) is covered by a low profile white oak or select species wood cover (83) with weather-seal (71) set in a milled reglet track (73) serving as a physical door, thermal, and air infiltration stop. The threshold assembly is secured to preinstalled/existing structural sub-straight by concealed or flush finish fasteners of compatible material. If required per installation, extended sill horns (813) are provided as part of sloped plate (812).

Alternate materials for the stainless steel/bronze threshold (81) include a single piece or multi-piece, machined, all bronze or all stainless steel plate assembly with slip resistant grooves or ridges (75) along the walk surface or machined single piece or, multi-piece all aluminum plate assembly with slip resistant grooves along the walk surface. Other materials for the stop block (82) include an all metal stop block compatible with adjacent threshold material and suitable for welded or threaded fastener attachment. Select species hardwood may be used as a stop block cover (83).

Door Frame

The preferred door frame (91) into which the operable door panels are installed (hung) is a Sapele Mahogany milled head and jamb frame with concealed fasteners into suitable adjacent building frame components. Applied interior trim component (92) is preferably Sapele Mahogany head and jamb profiled trim stop block with reglet track (73) weather-seal (71) installation. Alternative materials for the door frame (91) include exterior suitable hardwood compatible with selected door finish veneers, welded steel frame assembly of plate, channel or tube shapes, paint or applied veneer finish, with compatible stainless steel, bronze, or aluminum built-up/welded interior stop assembly with compatible (per adjacent door) applied finish or veneer covers. Alternative materials for the stop block trim (92) include steel, aluminum bar stock, or other appropriate materials suitable for welded or threaded fastening to a concealed steel frame assembly covered with a finished wood overlay per the selected door finish.

Figure 6:
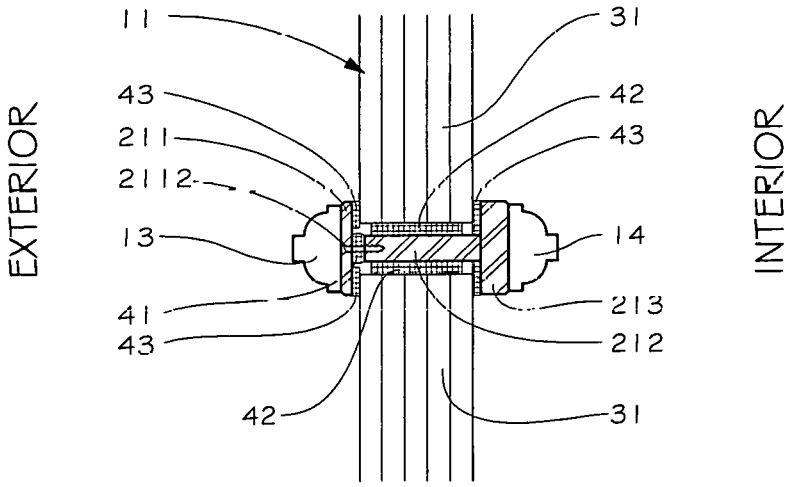
FIG. 6 is a detailed cross-sectional view of the muntin divide bar area of the security door as shown in FIG. 2.
Figure 7:
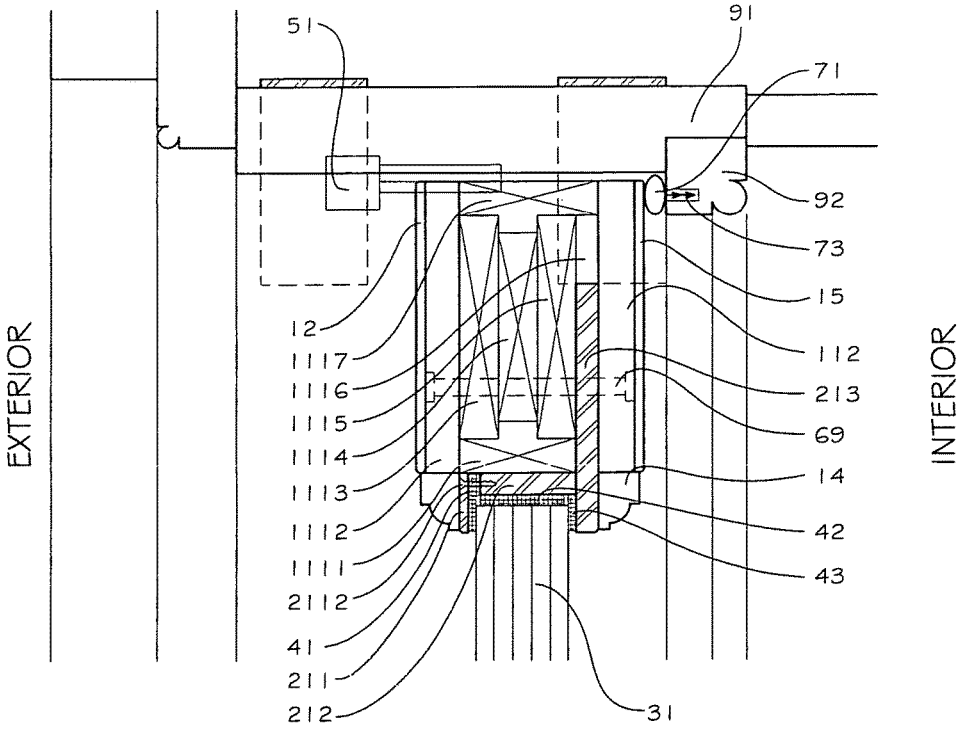
FIG. 7 is a detailed cross-sectional view of the top rail area of the security door as shown in FIG. 2.
Figure 8:
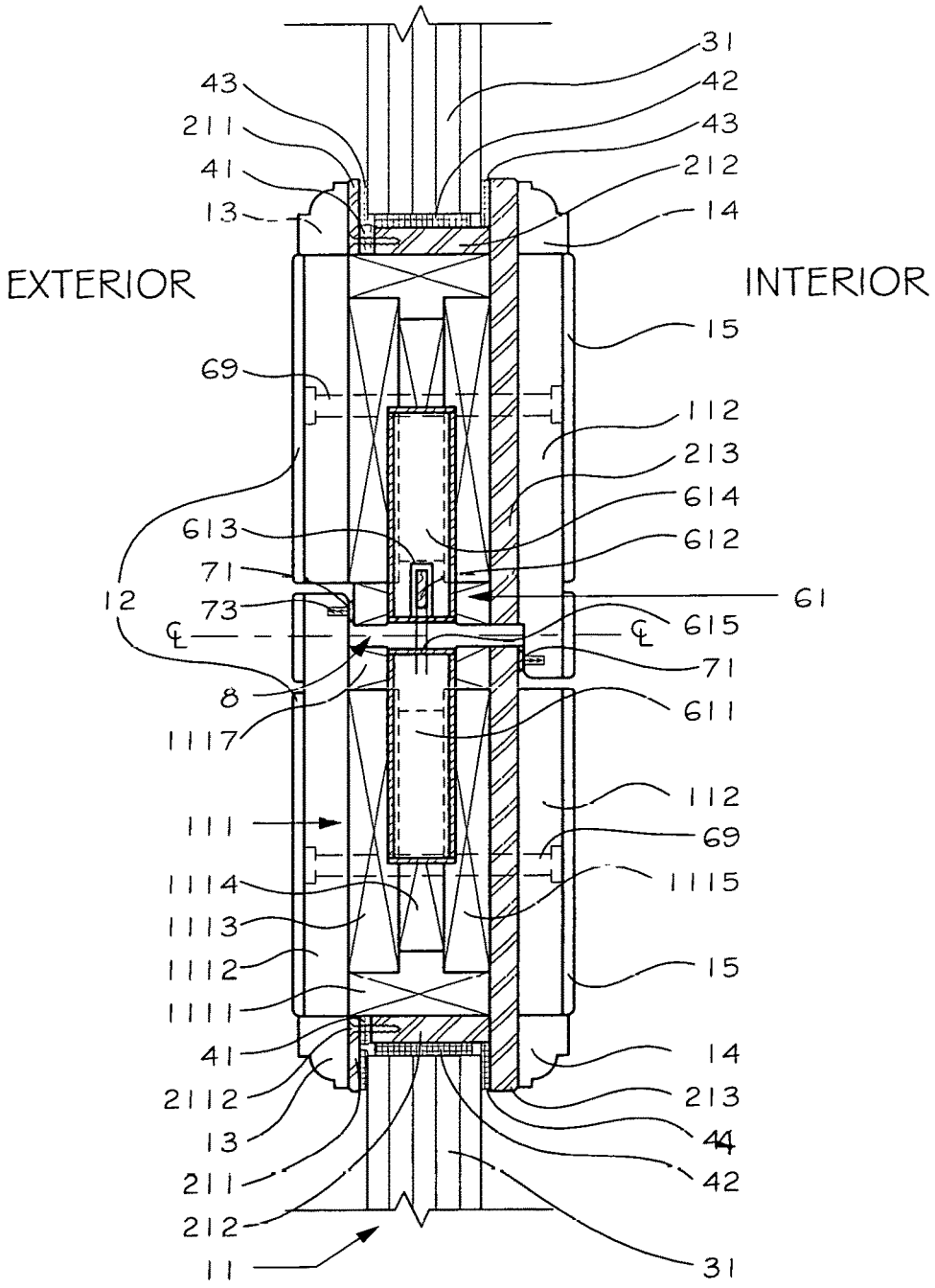
FIG. 8 is a detailed overhead cross-sectional view at the half-lap meeting stile area in proximity above the mortised multi-point lockset assembly portion of the paired doors as shown in FIG. 3, looking downward.
Figure 9:
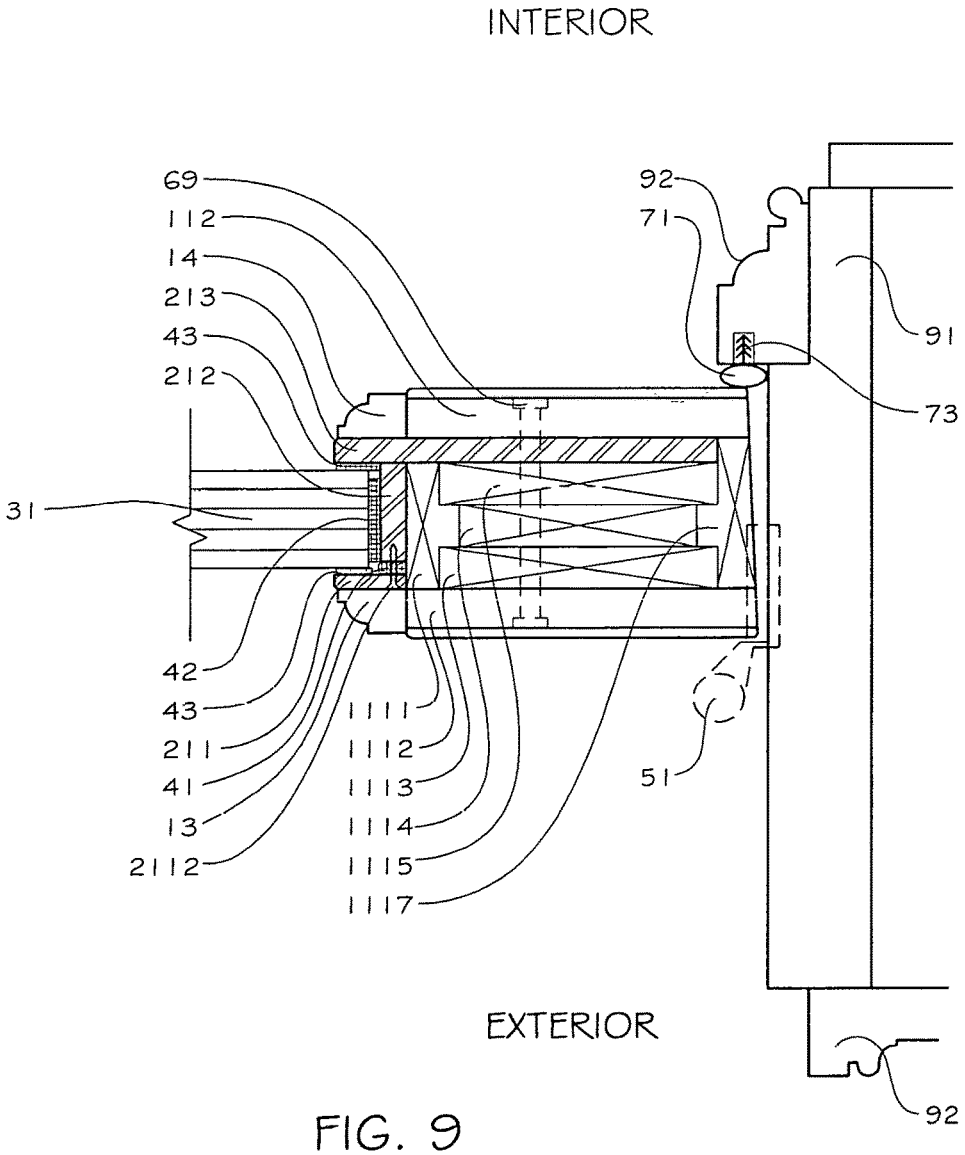
FIG. 9 is an overhead cross-sectional view of the jamb (stile) area of the security door as shown in FIG. 3 looking downward.

As illustrated in FIGS. 4 and 6, muntin divides (13) and (14) are preferably made from Sapele Mahogany as TDL (true divided lights) trim covers attached to steel core (211, 212, and 213) with 3M VHB (very high bond) 2-sided adhesive tape (43). Alternate attachment means include adhesive back magnetic strip tape (44) to allow easy removal of trim cover for maintenance or repair access.

Component Assembly Description:

With reference to FIGS. 4 through 20 inclusive, and the afore mentioned component materials description, the assembly of the security door (10) can be accomplished as follows:

Separate interior (112) and exterior (111) wood core laminates are bonded under pressure into individual rail and stile components in size and shape as required per design criteria. Exterior steel grid plate (211) and interior steel grid plate (213) are fabricated to required dimensional specifications using a CAD/CAM plasma cutter to insure exacting dimensional control, clean, precise 90 degree inside corners, and proper final assembly alignment of light divides and fasteners. The use of a CAD/CAM plasma cutter affords high degree of flexibility in producing custom/unique straight, curved or free form grid patterns within anticipated final assembly alignment tolerances. Steel middle core (212) flat bar stock components are fabricated to size/lengths required so as to be assembled into an 'egg crate' like grid assembly as containers and structural dividers for the individual glass panes (31). The 'egg crate' grid assembly (212) aligns along the centerline and inner perimeter of both flat grid plates (211 and 213) providing a pre-determined offset plane depth to be used as the structural glazing stop. 'Egg crate' divider (212) is welded to interior flat plate grid (213) which has been fabricated to extend a pre-determined dimension short of or flush with both rail and stile perimeter edges. Proximity to each edge relates to the threat angle necessary for a clear shot path. The combined 'egg crate' (212) and flat plate (213) constitute the primary structure component resisting a blunt force attack to the view portion of door.

The security door (10) component assembly procedure comprises of consists of the steps of a bonding connect edge (stile) to the end (rail) at four corners (with alignment dowels/biscuit) of the individual interior and exterior rail (2, 4) and stile (5) components forming separate four sided door panel 'frames'. Prior to final rail and stile assembly, wood core components (111, 112) receive 'as required' milling for inner and outer edge band blocks (1111, 1117). Half-lap meeting stile (8) weather-strip reglets (73), mortise lock/handle set housings (611, 614) shoot bolts (616) 'horn' hooks/keepers (612, 613), and pre-drill for concealed barrel nut bolts (69) are applied to the door. Structural steel plate/'egg crate' combined assembly (213, 212) is chemically bonded to a mill prepared interior wood core (112) immediately followed by alignment jig overlapping and perimeter bonding to mill prepared exterior wood core (111). Chemically bonded, inserted and mechanically fastened mill prepared edge band blocks (1111, 1117) are inserted/secured with barrel nut bolts (69). The multi-point clamping pressure is applied to the door assembly surface/edges and re-tighten barrel nut through bolts.

Selected structural glazing tape (43) is placed on the glass contact face of the interior steel plate (213) structural glazing stop surface to all four sides of each separate divide. The pre-fabricated (size, shape and thickness) bullet resistant glass panes (31) are placed in appropriate 'egg crate' divided sections, verifying that polycarbonate layer of glass pane (31) is the interior surface. At a minimum, two semi-rigid neoprene setting blocks/shims (42) are provided along the bottom (weight bearing) edge of the glass/steel 'egg crate' grid interface. Optionally, similar neoprene setting blocks/shims may be placed along the other three edge surfaces of the glass/steel 'egg crate' to restrict lateral movement or provide additional thermal separation of the glass component.

Selected thermal break material (41) is placed onto the edge of 'egg crate' grid (212) providing a physical/material separation between steel core components (211 and 213). Optionally structural glazing tape (43) can be applied to the inside grid and perimeter of the exterior flat plate steel grid (211). The exterior flat plate grid (211) is aligned and placed over thermal break material providing the exterior structural glazing stop. The exterior plate (211) is secured to divide the 'egg crate' grid core (212) with countersunk stainless steel flat head screws (2112). The screws (2112) are tightened to slightly compress thermal break material (41) providing a positive glazing stop and weather seal.

For ease of field installation, the present invention allows for the entire glazing assembly components (which constitutes the largest percentage weight component of the security door) to be field installed following on site door panel installation, alignment, and finished hardware component installation. The assembly design allows for on-site glazing from interior structural glazing tape (43) through all subsequent assembly components, applied exterior veneers (12), and the final applied exterior muntin divide trim (13). Additionally, this same field glazing flexibility allows in-place future access to the entire glazing assembly if required for maintenance or replacement of damaged glass panes.

Whether to be hinge set glazed or field glazed, or unglazed, the finishing of the (visual/aesthetic) component material assembly procedure consists of bonding of the interior (15) veneer and exterior (12) veneer or 'as specified' finished adhered skin, paint, metallic coating or other alternate exterior and interior materials described elsewhere are applied as shop or field finishes. Installation of the selected flush hardware, hinges, locksets and subsequent alignment and balancing of door are concurrent with the field installation of frame and door assembly. If the field glazing option is selected, exterior muntin divide trim (13) requires use of the adhesive back magnetic strip alternate for future removal and reinstallation of the trim assembly.

FIGS. 13-17 illustrate uses of a solid two piece core assembly alternate embodiment wherein the wood is shown by curved lines depicting the shading of the wood areas of the door.

Figure 13:
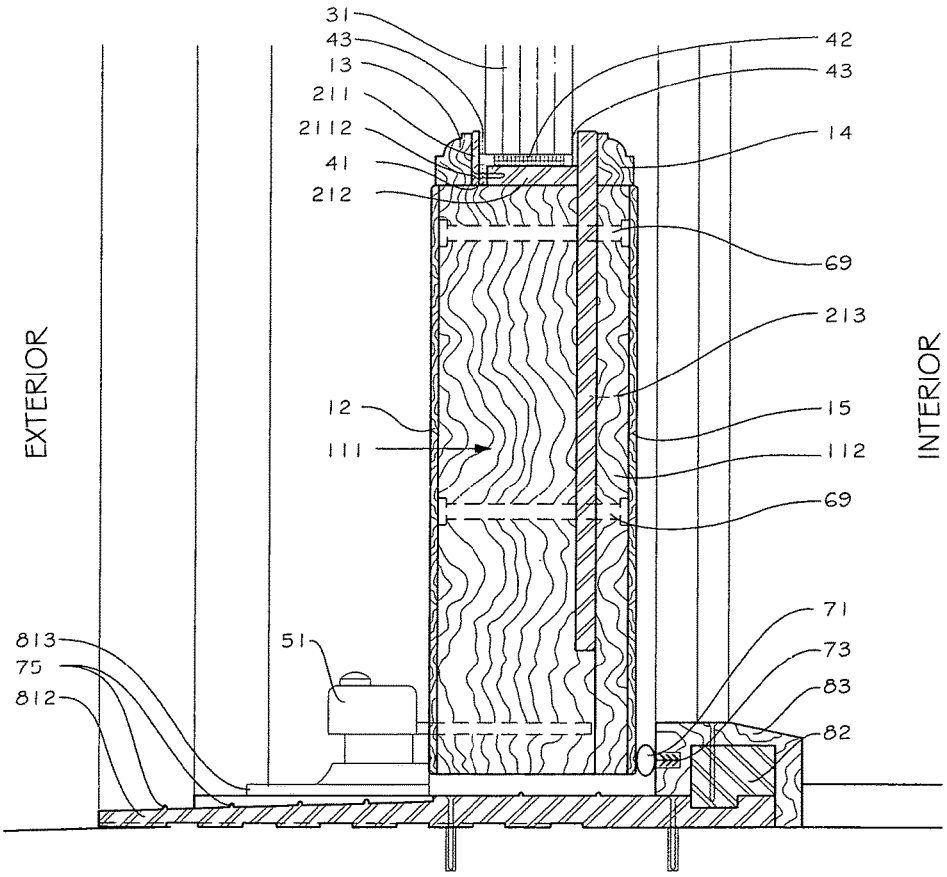
FIG. 13 is an alternate embodiment of FIG. 5 showing a cross-sectional view of the bottom rail area illustrating use of a two piece solid wood core assembly alternate.

As best illustrated in FIG. 13, a bottom rail design with a laminated glass (31), a glazing tape (43) positioned with respect to the neoprene setting block/stop (42) for shimming the glass (31), and the muntin divide (13) disposed within a steel grid (211), a steel divider member (212) and a steel panel (213). The veneer (12), is shown covering the exterior wood core assembly (111). The hinge (51) is shown in proximity to the overlapping threshold (81) plates together with the stop block (82), stop block cover (83), and weather seal (71).

Figure 14:
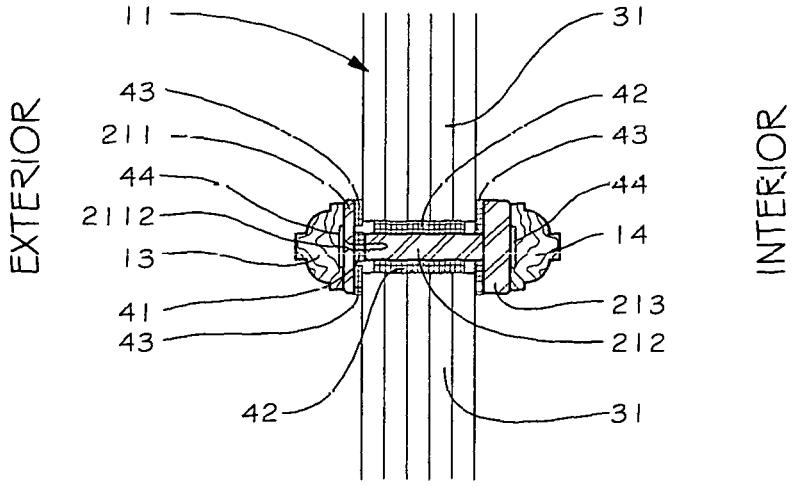
FIG. 14 is an alternate embodiment of FIG. 6 showing a vertical or horizontal muntin divide in a detailed cross-sectional view of the muntin area of the security door.

An alternate muntin divide detail assembly using adhesive back magnetic strip tape allowing access to steel panels for maintenance or replacement of individual glass panels (31) is shown in FIG. 14.

Figure 15:
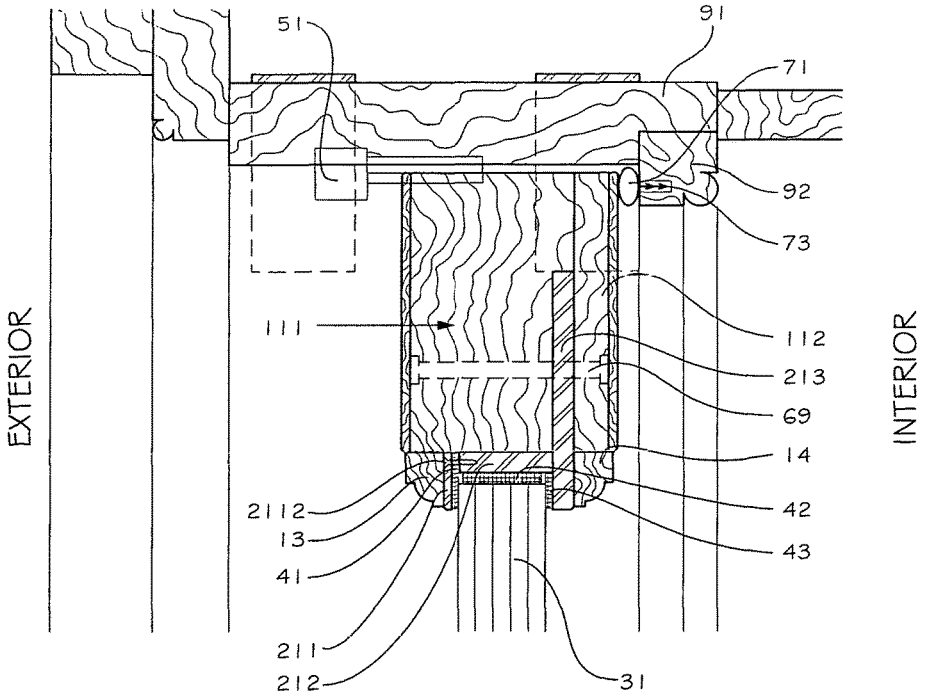
FIG. 15 is an alternate embodiment of FIG. 7 showing a cross-sectional side view of the top rail assembly area illustrating use of a two piece solid wood core assembly alternate of the security door.

FIG. 15 illustrates, the top rail with the laminated glass panes (31) covered by a sheet of polycarbonate on the interior side and held in position within the steel divider and optionally secured with a structural glazing tape (43) or thermal break material.

Figure 16:
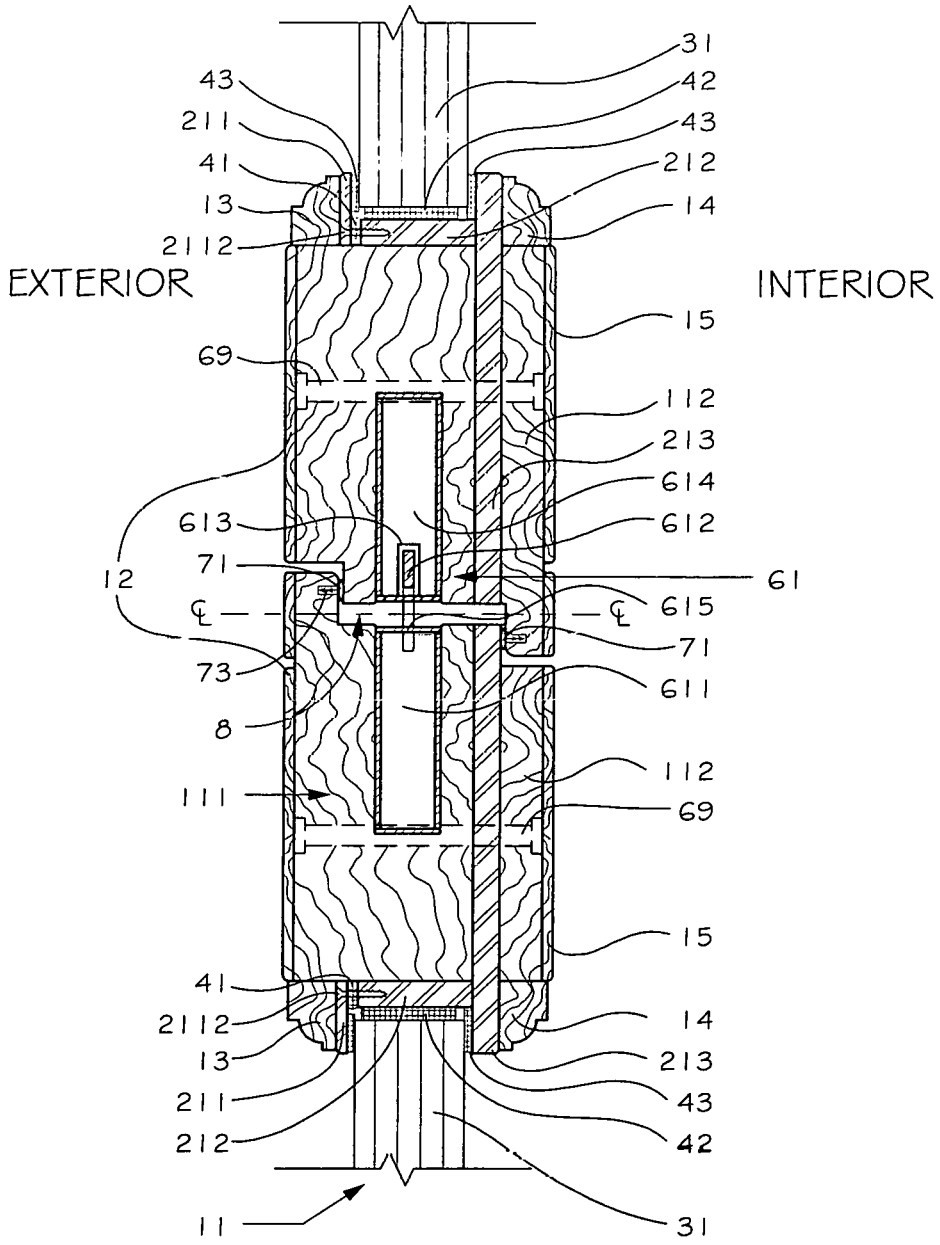
FIG. 16 is an alternate embodiment of FIG. 8 showing an overhead cross-sectional view at the half-lap meeting stile area, of the top portions in proximity above the mortised multi-point lockset portion of the panel doors, illustrating use of a two piece solid wood core assembly alternate of the two doors looking downward.

The half lap meeting stile details are shown in FIG. 16, whereby the half lap design minimizes the physical separation of steel plates (213) on double door applications. The design also eliminates a clear visual or projectile path between the meeting stiles.

Figure 17:
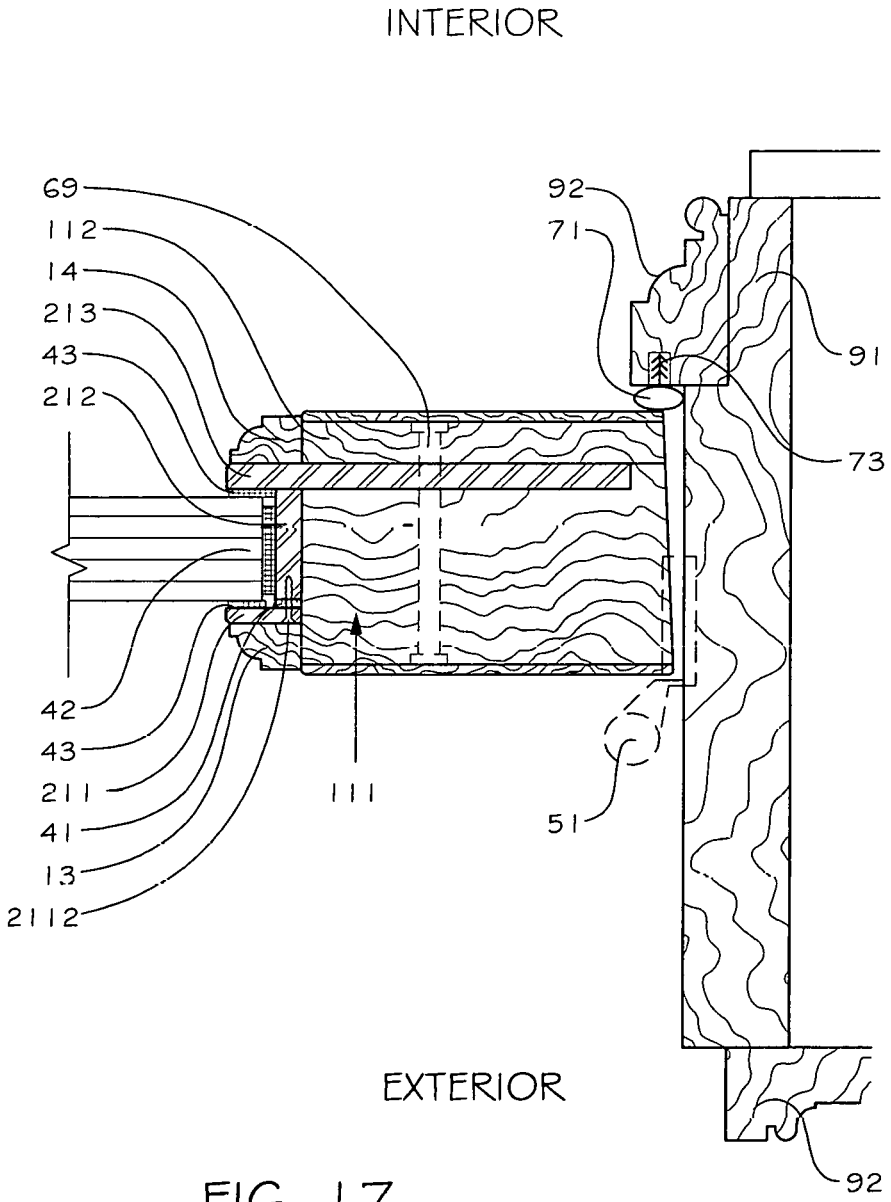
FIG. 17 is an alternate embodiment of FIG. 9 showing an overhead cross-sectional view of the jamb (stile) assembly illustrating use of a two piece solid wood core assembly alternate of the security door as shown in FIG. 3 looking downward.
Figure 18:
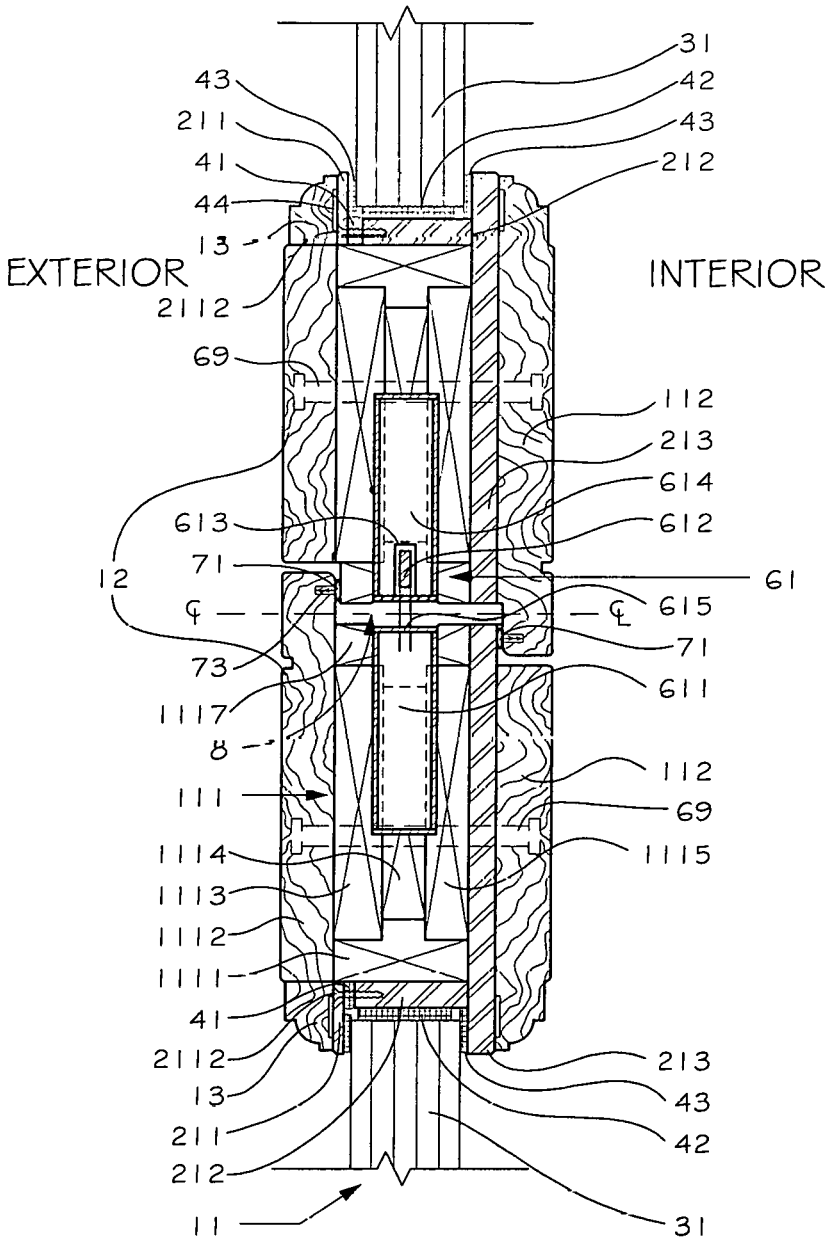
FIG. 18 is an alternate embodiment showing the assembly detail of an overhead cross-sectional view of the half-lap meeting stile area in proximity above the mortised multi-point lockset assembly portions of the paired doors as shown in FIGS. 3 & 8, looking downward.

FIG. 17 illustrates a jamb detail embodiment showing an overhead cross-sectional view of the jamb area of the security door looking downward. It illustrates the basic component assembly of wood, steel, glass, through-bolt fasteners (69) and hinge hardware (51). FIG. 18 shows the assembly detail of an overhead cross-sectional view at the half-lap meeting stile area of the top portions of the two doors looking downward; this assembly illustrates exterior finish panel (111) and interior finish panel (112) as solid wood members as opposed to veneer finish.

Figure 19:
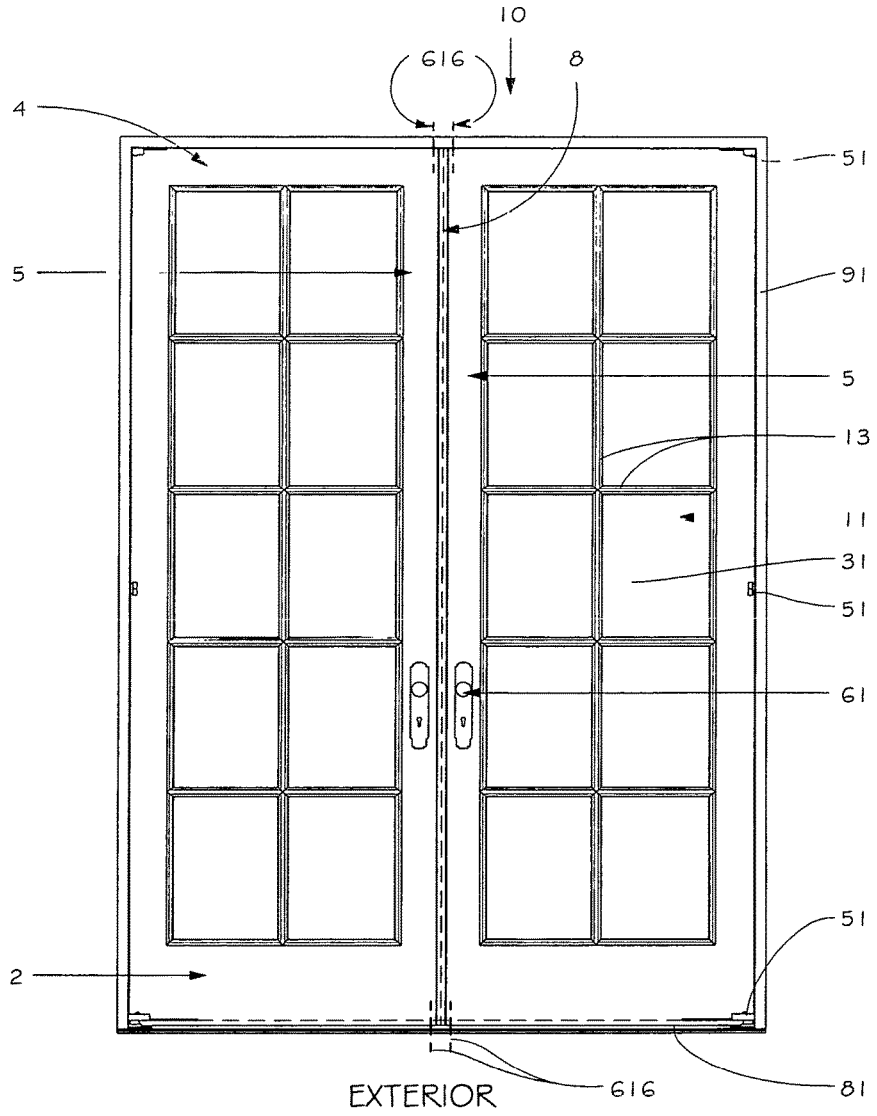
FIG. 19 is an elevated exterior view of a paired rail and stile, true divide 10-light, multipoint locking, ballistic resistant security door of the present invention.
Figure 20:
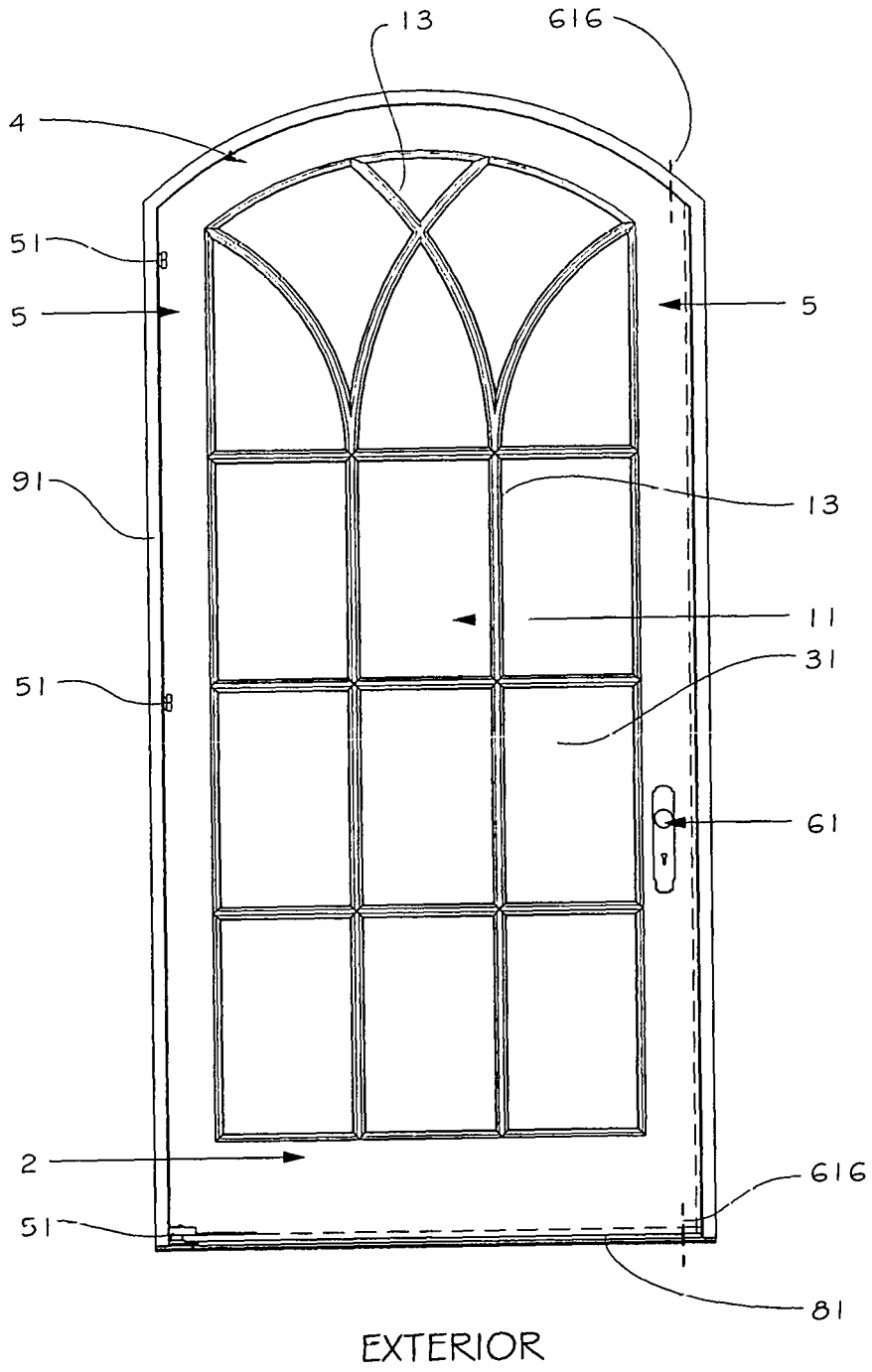
FIG. 20 is an elevated exterior view of an alternate design configuration of a single, arched top rail, multiple curved and rectilinear TDL glass panes, multipoint locking, and ballistic resistant security door.

FIG. 19 is an elevated exterior view of a paired rail and stile, true divide 10-light, multipoint locking, ballistic resistant security door of the present invention. An elevated exterior view is shown in FIG. 20 with a design configuration of a single, arched top rail, multiple curved and rectilinear TDL glass panes, multipoint locking, and ballistic resistant security door.

Figure 21:
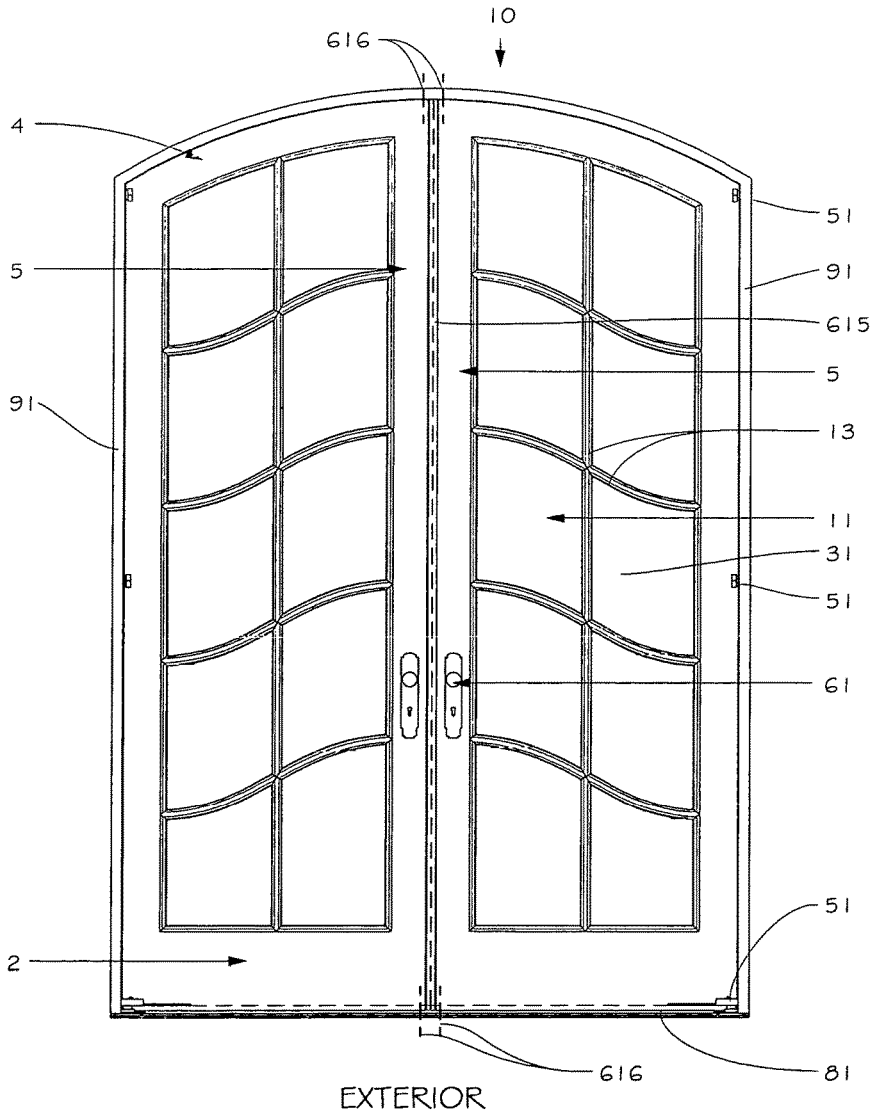
FIG. 21 is an elevated exterior view of an alternate design configuration of a pair of arched top rail, multiple curved and rectilinear TDL glass panes, multipoint locking, and ballistic resistant security door. Design configuration is for illustration, as many other door shape and light divide layout configurations are possible.

FIG. 21 shows an elevated exterior view of an alternate design configuration of a pair of arched top rail, multiple curved and rectilinear TDL glass panes, multipoint locking, and ballistic resistant security door. The design configuration is for illustration, as many other door shape and light divide layout configurations are possible.

Figure 22:
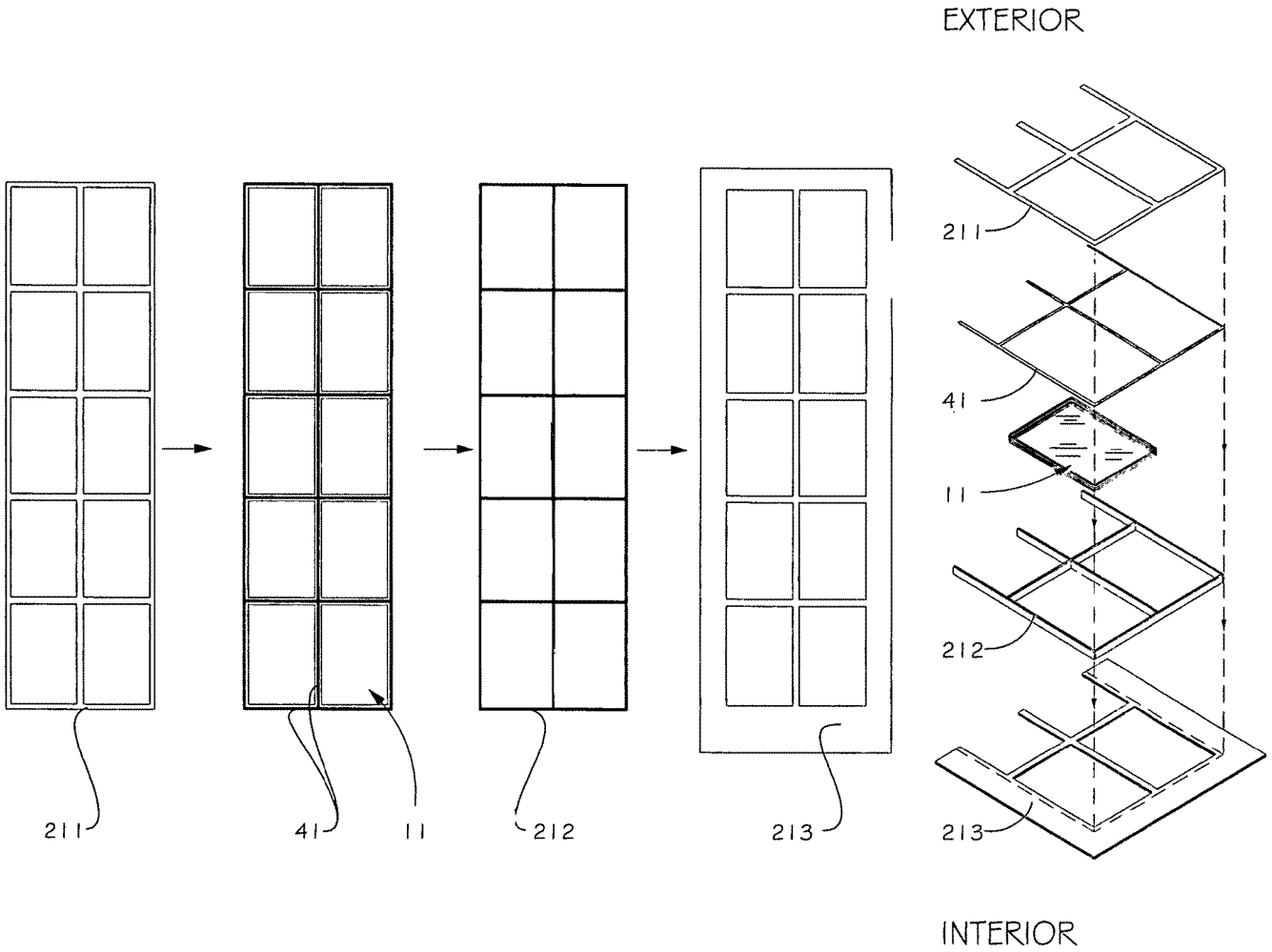

FIG. 22 is an order of assembly axon illustrating the security door steel components wherein the steel grid dividers (212) are welded onto the interior steel core plate (213), the exterior steel core grid plate (211) secures in place the bullet resistant glass pane assembly (11) and secured to the steel grid dividers (212) with countersunk threaded fasteners (2112) through thermal break material providing thermal conductivity separation.

The foregoing detailed description is given primarily for clearness of understanding and no unnecessary limitations are to be understood, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

We claim:

1. A projectile resistant security panel, comprising:

a frame comprising structural members selected from the group consisting of steel, metal, stainless steel, copper, bronze, aluminum, titanium, wood, graphite polymer, graphene polymer, polyethylene polymers, nylon, and combinations thereof;

an exterior muntin divide trim cover;

an exterior veneer;

an exterior wood core;

an exterior flat grid comprised of a steel, a stainless steel, a copper, a bronze, an aluminum, a titanium, a graphite polymer, a graphene polymer, a polyethylene polymers, a polycarbonate, a carbon fiber, and combinations thereof;

a layer of thermal break material;

at least one pane of a projectile resistant transparent or translucent light transmitting material comprising a plurality of layers of a glass, a polycarbonate, a synthetic translucent material layer, and combinations thereof;

said at least one pane of said projectile resistant transparent or translucent light transmitting material is disposed in a divider grid, said grid comprising a steel, a stainless steel, a copper, a bronze, an aluminum, a titanium, a graphite polymer, a graphene polymer, a polyethylene polymers, a polycarbonate, a carbon fiber, and combinations thereof;

an interior wood core;

an interior steel core panel member;

an interior veneer; and an interior muntin divide trim.

2. The projectile resistant security panel of claim 1, said layer of thermal break material preventing condensation between said plurality of layers of glass and said exterior flat grid, flat grid comprises a strip of insulating material disposed between said at least one pane of projectile resistant transparent or translucent light transmitting material disposed in said divider grid and said exterior flat grid, comprising a glazing tape, a two sided adhesive polyvinyl chloride material, a neoprene material, a closed cell foam glazing tape, a semisolid chalk, and a silicone material.

3. The projectile resistant security panel of claim 1, including neoprene blocks or strips disposed between a lower edge of said at least one pane of said projectile resistant transparent or translucent light transmitting material and said divider grid.

4. The projectile resistant security panel of claim 1, wherein said exterior wood core comprises a multi-layer exterior wood core.

5. The projectile resistant security panel of claim 1, wherein said interior wood core comprises a multi-layer interior wood core.

6. The projectile resistant security panel of claim 1, including a door comprising a pair of horizontal rails joining a pair of vertical stiles, said pair of horizontal rails and said pair of vertical stiles connecting at respective corners forming a door panel.

7. The projectile resistant security panel of claim 6, wherein said door comprises at least one wood layer bonded to at least one steel layer.

8. A projectile resistant security panel, comprising:

a frame comprising structural members selected from the group consisting of steel, metal, stainless steel, copper, bronze, aluminum, titanium, wood, graphite polymer, graphene polymer, polyethylene polymers, nylon, and combinations thereof;

an exterior veneer;

an exterior wood core;

an exterior flat grid comprised of a steel, a stainless steel, a copper, a bronze, an aluminum, a titanium, a graphite polymer, a graphene polymer, a polyethylene polymers, a polycarbonate, a carbon fiber, and combinations thereof;

a layer of thermal break material;

at least one of pane of a projectile resistant transparent or translucent light transmitting material comprising a plurality of layers of a glass, a polycarbonate, a synthetic translucent material layer, and combinations thereof;

said at least one pane of said projectile resistant transparent or translucent light transmitting material is disposed in a divider grid, said grid comprising a steel, a stainless steel, a copper, a bronze, an aluminum, a titanium, a graphite polymer, a graphene polymer, a polyethylene polymers, a polycarbonate, a carbon fiber, and combinations thereof;

an interior wood core;

an interior steel core panel member; and an interior veneer.

9. The projectile resistant security panel of claim 8, said layer of thermal break material preventing condensation between said plurality of layers of glass and said exterior flat grid comprises a strip of insulating material disposed between said at least one pane of projectile resistant transparent or translucent light transmitting material disposed in said divider grid and said exterior flat grid, comprising a glazing tape, a two sided adhesive polyvinyl chloride material, a neoprene material, a closed cell foam glazing tape, a semisolid chalk, and a silicone material.

10. The projectile resistant security panel of claim 8, including neoprene blocks or strips disposed between a lower edge of said pane and said divider grid.

11. The projectile resistant security panel of claim 8, wherein said exterior wood core comprises a multi-layer exterior wood core.

12. The projectile resistant security panel of claim 8, wherein said interior wood core comprises a multi-layer interior wood core.

13. The projectile resistant security panel of claim 8, including a door comprising a pair of horizontal rails joining a pair of vertical stiles, said pair of horizontal rails and said pair of vertical stiles connecting at respective corners forming a door panel.

14. The projectile resistant security panel of claim 8, including an interior muntin divide trim.

15. The projectile resistant security panel of claim 8, including an exterior muntin divide trim.

16. A projectile resistant security panel, consisting essentially of:

a frame comprising structural members selected from the group consisting of steel, metal, stainless steel, copper, bronze, aluminum, titanium, wood, graphite polymer, graphene polymer, polyethylene polymers, nylon, and combinations thereof;

an exterior veneer;

an exterior wood core;

an exterior flat grid comprised of a steel, a stainless steel, a copper, a bronze, an aluminum, a titanium, a graphite polymer, a graphene polymer, a polyethylene polymers, a polycarbonate, a carbon fiber, and combinations thereof;

a layer of thermal break material;

at least one of pane of a projectile resistant transparent or translucent light transmitting material comprising a plurality of layers of a glass, a polycarbonate, a synthetic translucent material layer, and combinations thereof;

said at least one pane is disposed in a divider grid, said grid comprising a steel, a stainless steel, a copper, a bronze, an aluminum, a titanium, a graphite polymer, a graphene polymer, a polyethylene polymers, a polycarbonate, a carbon fiber, and combinations thereof;

an interior wood core;

an interior steel core panel member; and an interior veneer.

* * * * *